US007107771B2

(12) United States Patent
Eroglu et al.

(10) Patent No.: US 7,107,771 B2
(45) Date of Patent: Sep. 19, 2006

(54) METHOD FOR INTRODUCING FUEL INTO A PREMIX BURNER

(75) Inventors: Adnan Eroglu, Untersiggenthal (CH); Andreas Schmid, Remetschwil (CH); Peter Stuber, Zurich (CH)

(73) Assignee: ALSTOM Technology Ltd., Baden (CH)

( * ) Notice: Subject to any disclaimer, the term of this patent is extended or adjusted under 35 U.S.C. 154(b) by 0 days.

(21) Appl. No.: 10/381,519

(22) PCT Filed: Oct. 1, 2001

(86) PCT No.: PCT/CH01/00589

§ 371 (c)(1),
(2), (4) Date: Jul. 18, 2003

(87) PCT Pub. No.: WO02/29329

PCT Pub. Date: Apr. 11, 2002

(65) Prior Publication Data

US 2004/0088996 A1 May 13, 2004

(30) Foreign Application Priority Data

Oct. 5, 2000 (DE) ..... 100 49 203

(51) Int. Cl.
*F02C 1/00* (2006.01)

(52) U.S. Cl. ..... 60/737; 60/740; 60/742

(58) Field of Classification Search ..... 60/737, 60/738, 776, 739, 742
See application file for complete search history.

(56) References Cited

U.S. PATENT DOCUMENTS 4,589,260 A 5/1986 Krockow ..... 60/737
5,054,280 A 10/1991 Ishibashi et al.
5,154,059 A * 10/1992 Keller ..... 60/737
5,289,685 A * 3/1994 Hoffa ..... 60/739
5,307,634 A 5/1994 Hu ..... 60/737
5,321,949 A * 6/1994 Napoli et al. ..... 60/739
5,375,995 A * 12/1994 Dobbeling et al. ..... 431/8
5,664,943 A 9/1997 Joos et al.
5,687,571 A * 11/1997 Althaus et al. ..... 60/737
5,699,667 A * 12/1997 Joos ..... 60/737
5,899,076 A * 5/1999 Snyder et al. ..... 60/740
6,038,863 A * 3/2000 Keller et al. ..... 60/742
6,098,406 A * 8/2000 Bolis et al. ..... 60/737
6,397,602 B1 * 6/2002 Vandervort et al. ..... 60/737

(Continued)

FOREIGN PATENT DOCUMENTS

DE 42 12 810 A1 10/1992

(Continued)

OTHER PUBLICATIONS

International Search Report, prepared by the European Patent Office, for PCT Appl. No. PCT/CH01/00589, dated Jan. 3, 2002.

(Continued)

*Primary Examiner*—William H. Rodriguez
(74) *Attorney, Agent, or Firm*—Cermak & Kenealy, LLP; Adam J. Cermak

(57) ABSTRACT

A method and a device for the introduction of fuel into a premixing burner, with a pilot gas feed and a premix gas feed for the operation of a gas turbine in the entire load range, in which the pilot gas feed is carried out via a burner lance provided in the premixing burner and the premix gas feed is carried out via side wall shells of the premixing burner. The premix gas feed and the pilot gas feed are carried out in combination, in such a way that a continuous mixture ratio between premix gas and pilot gas can be set within the premixing burner.

3 Claims, 1 Drawing Sheet

U.S. PATENT DOCUMENTS

| | | | | |
|---|---|---|---|---|
| 6,981,358 | B1 * | 1/2006 | Bellucci et al. | 60/39.17 |
| 2002/0026796 | A1 * | 3/2002 | Gutmark et al. | 60/737 |

FOREIGN PATENT DOCUMENTS

| | | |
|---|---|---|
| DE | 44 46 945 A1 | 7/1996 |
| DE | 195 20 292 | 12/1996 |
| DE | 195 45 310 | 6/1997 |
| WO | WO 00/12936 | 3/2000 |

OTHER PUBLICATIONS

Search Report from DE 100 49 203.7 (Feb. 25, 2004).

* cited by examiner

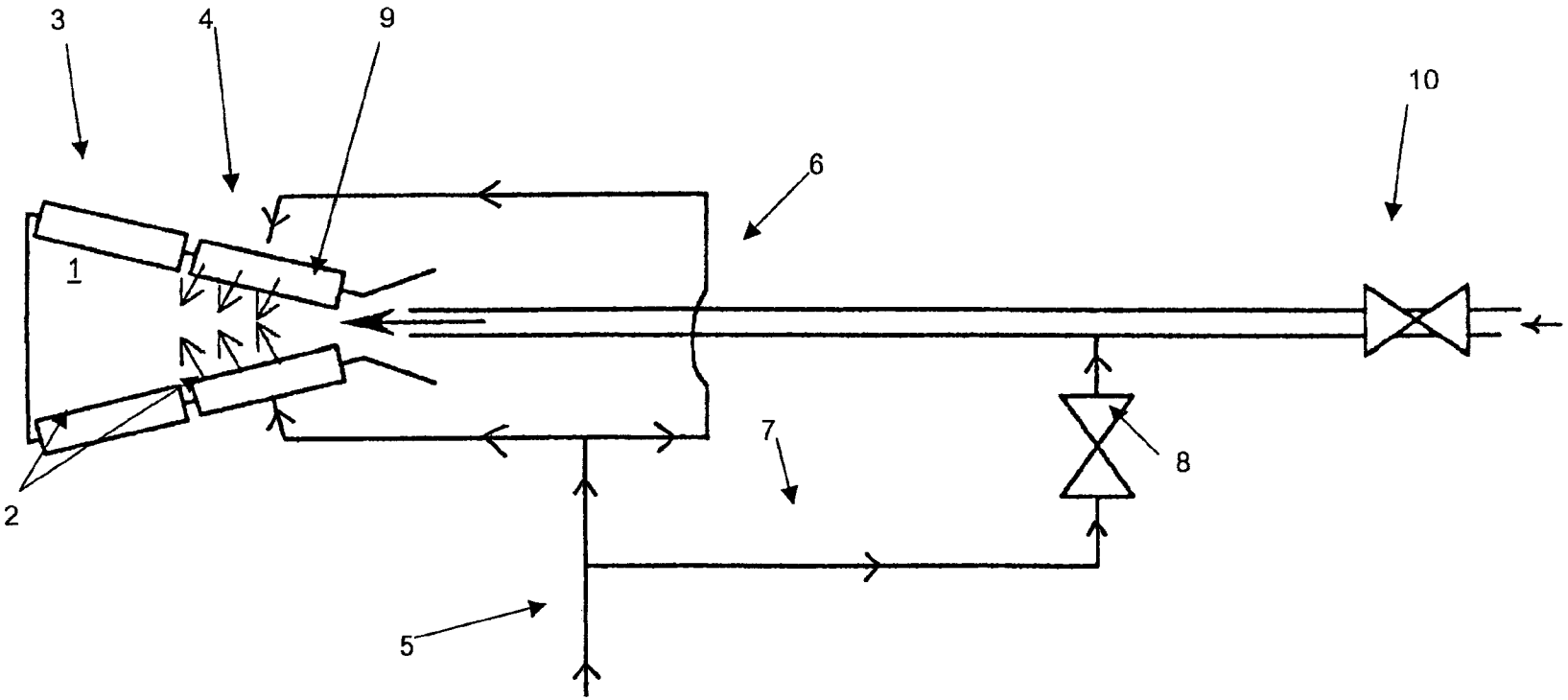
10
8
6
7
9
5
4
3
1
2

METHOD FOR INTRODUCING FUEL INTO A PREMIX BURNER

This is a U.S. national stage application of International Application Number PCT/CH01/00589, filed Oct. 1, 2001, published as WO 02/29329 in German, and claims priority to German application number 100 49 203.7, filed Oct. 5, 2000, the entirety of both of which is incorporated by reference herein.

TECHNICAL FIELD

The invention relates to a method and a device for the introduction of fuel into a premixing burner, with a pilot gas feed and a premix gas feed for the operation of a gas turbine for the entire load range, the pilot gas feed being carried out via a burner lance provided in the premixing burner and the premix gas feed being carried out via side wall shells of the premixing burner.

PRIOR ART

Premixing burners for the operation of gas turbine plants are operated in a way known per se with different fuel feed systems, so that the entire load range of a gas turbine can be covered, that is to say from the ignition and starting phase up to the full-load range of the gas turbine. Thus, during starting and also in lower load ranges of gas turbines, premixing burners are supplied with pilot gas which is fed usually via a central burner lance into the interior of the premixing burner. After the start and run-up of the combustion operation have taken place within the premixing burner, there is a pilot/premix changeover, in which, to raise the burner capacity and a consequently necessary increased supply of fuel, premix gas flows into the interior of the premixing burner through hole ducts which are provided inside the burner shells enclosing the premixing burner. During the changeover to premix operation, however, high pulsations occur, with the effect of oscillating pressure fluctuations which markedly reduce the useful life of the combustion chamber following the premixing burner and of the downstream gas turbine. Even in the event of mixed operation, that is to say a simultaneous feed of pilot gas and premix gas into the interior of the premixing burner, only unsatisfactory combustion results are obtained, especially since the pilot gas addition maintained during the premix gas feed considerably disturbs the vortex core of the combustion air flowing into the premixing burner. A satisfactory coordination between the pilot gas supply and the premix gas supply is not possible by means of the conventional arrangements.

In order nevertheless to achieve acceptable combustion qualities, particularly in the low load range, the burner lance, which projects into the interior of the premixing burner and via which a pilot gas feed takes place, is designed in such a way that, under low loads, the combustion operation is run solely via the pilot gas supply, the premix stage remaining inoperative. In order to make such an operating mode possible, however, it is necessary for the selected line cross section of the burner lance to be correspondingly large, so that a pilot gas supply can be made available to the premixing burner to a sufficient extent even for the lower load range. Burner lances with such a large line cross section are not suitable for mixed operation, however, since this gives rise to an increased extent to the above-described irritation in the inflowing combustion air and may generate undesirable combustion chamber pulsations in an intensifying way.

PRESENTATION OF THE INVENTION

The object of the invention to develop a method for the introduction of fuel into a premixing burner, with a pilot gas feed and a premix gas feed for the operation of a gas turbine in the entire load range, in which the pilot gas feed is carried out via a burner lance provided in the premixing burner and the premix gas feed is carried out via burner shells of the premixing burner, in such a way that a feed of pilot gas and of premix gas becomes possible, while avoiding the above-mentioned disadvantages, in particular while avoiding combustion chamber pulsations and the disturbing influence on the flow conditions of the combustion inflow air. In particular, the method according to the invention is to simplify the operation of conventional premixing burners, in particular a corresponding device is to be provided, by means of which the above-described operating mode can be implemented, without extra outlay in structural terms and in terms of cost being incurred at the same time.

Features advantageously developing the idea of the invention may be gathered from the description by reference to the drawing.

According to the invention, a method embodying principles of the present invention is designed in that the premix gas feed and the pilot gas feed are carried out in combination, in such a way that a continuous mixture ratio between premix gas and pilot gas can be set within the premixing burner, and in such a way that liquid fuel is fed into the premixing burner via the burner lance, via which the pilot gas feed takes place, alternatively, that is to say with the pilot gas supply being prevented completely.

The idea on which the invention is based proceeds from the fact that the pilot gas supply is carried out within the premixing burner via that delivery line via which liquid fuel is conventionally supplied to the central nozzle which is positioned in the burner mouth. A combination of this kind, to be precise the alternative supply of pilot gas or liquid fuel through a common delivery line which issues centrally in the burner mouth, assists in avoiding the disadvantages associated with the customary supply of pilot gas via a separate burner lance, as stated in the description introduction. The axial pilot gas supply axial in relation to the longitudinal extent of the premixing burner can implement the ignition action and operation in the lower load range of the premixing burner, but it is also possible, furthermore, to run a continuous transition to the full-load range, in that premix gas is additionally fed in a metered manner into the interior of the premixing burner via the burner shells. The combination between the central pilot gas feed and the premix gas feed makes it possible, inter alia, to keep the axial directed gas stream low, with the result that adverse influences with regard to the formation of combustion chamber pulsations can be effectively counteracted.

It is particularly advantageous to carry out the premix gas feed via the burner shells in a staged manner, that is to say the burner shells are divided into different sections which are connected separately from one another to premix gas delivery lines, so that the individual burner shell sections can be operated with a different premix gas supply. At least, the burner shells are subdivided into two sections which can be fed in each case individually by means of premix gas.

BRIEF DESCRIPTION OF THE INVENTION

The invention is described below by way of example, without any restriction of the general idea of the invention, by means of an exemplary embodiment, with reference to the drawing.

The exemplary embodiment executed in the FIGURE has a premixing burner 1, the burner shells 2 of which are divided into two different sections 3 and 4. The first of the two sections 3 is supplied with premix gas via a delivery line 5. Of course, a corresponding delivery line, not illustrated, is also provided for the section 4 for the specific infeed of premix gas. Gas in the form of pilot gas, which serves for purposes of starting and of the lower load range of the burner, may be fed into the burner mouth 9 of the premixing burner 1, by way of a branch line 7 and a corresponding throttle valve 8, via a burner lance 6 projecting centrally and axially into the premixing burner 1. In addition, upstream, within the burner lance 6, a further throttle valve 10 is provided, via which a specific delivery of liquid fuel via the burner lance 6 is possible.

The throttle valves 8 and 10 are in each case to be set in such a way that either the supply of pilot gas or the sole supply of liquid fuel is possible. During the starting phase and in the low load range, the throttle valve 8 is opened, with the throttle valve 10 closed, with the result that pilot gas passes axially into the premixing burner 1 and is intermingled there with air, to form an ignitable mixture which, after emerging from the premixing burner 1, is ignited in a combustion chamber, not illustrated. When the part-load range of combustion is reached, at least a first stage or section 1 of the burner shells is opened, via which premix gas is fed specifically into the interior of the premixing burner 1. The premix gas supply and the supply of the pilot gas take place continuously in a regulated manner, so that any desired mixture ratios between premix gas and pilot gas can be set inside the premixing burner 1. When full load is reached, all the sections of the premixing burner are supplied with premix gas, the pilot gas supply being switched off completely. Opening of the throttle valve 10 ensures the ingress of liquid fuel into the interior of the premixing burner for a further increase in the combustion operation.

In contrast to pilot systems known per se, the combined operation of axial pilot gas injection with premix gas injection by means of the staged supply of premix gas via the sections 1 and 2 shown in the exemplary embodiment—it is, of course, also possible to subdivide the burner shells of the premixing burner into more sections than shown in the exemplary embodiment—makes it possible to keep the axial pilot gas stream low, with the result that the necessary line cross section for the axial pilot gas supply can be greatly reduced and the large line cross sections known in the prior art are not required. By virtue of the axial pilot gas supply, it becomes possible for the first time also to utilize the fuel delivery line which in any case has small cross-sectional dimensioning and through which liquid fuel is supplied. The invention, at the moment, affords the advantage of using a single, centrally positioned fuel pipe which is oriented axially to the premixing burner and through which liquid fuel or pilot gas can be supplied to the combustion operation, depending on the position of the throttle valves 8 and 10.

LIST OF REFERENCE SYMBOLS

1 Premixing burner
2 Burner shells
3 Section
4 Section
5 Delivery line
6 Burner lance
7 Branch line
8 Throttle valve
9 Burner mouth
10 Throttle valve

The invention claimed is:

1. A device for the introduction of fuel into a premixing burner useful for operating a gas turbine in the entire load range, comprising:

a burner lance positioned axially in the center of the premixing burner;

burner shells;

a supply line in fluid communication with the burner lance, configured and arranged to supply liquid fuel or gas fuel to the burner lance;

a pilot gas feed in fluid communication with the burner lance supply line;

a premix gas feed in fluid communication with the burner shells of the premixing burner;

a common gas delivery line system through which premix gas and pilot gas can be fed into the premixing burner;

at least a first regulating unit configured and arranged to regulate the feed of pilot gas through the supply line to the burner lance; and at least a second regulating unit configured and arranged to regulate the supply of liquid fuel through the supply line to the burner lance.

2. The device as claimed in claim 1, wherein the at least first regulating unit comprises a throttle valve configured and arranged to throttle the supply of pilot gas to the burner lance.

3. The device as claimed in claim 1, wherein the burner lance is arranged centrally, axially, coaxially in the premixing burner, or combinations thereof.

* * * * *